US009972938B2

(12) United States Patent
Imai

(10) Patent No.: US 9,972,938 B2
(45) Date of Patent: May 15, 2018

(54) CONNECTOR

(71) Applicant: Sumitomo Wiring Systems, Ltd., Yokkaichi, Mie (JP)

(72) Inventor: Yasuo Imai, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days. days.

(21) Appl. No.: 15/523,967

(22) PCT Filed: Nov. 9, 2015

(86) PCT No.: PCT/JP2015/081442

§ 371 (c)(1),
(2) Date: May 3, 2017

(87) PCT Pub. No.: WO2016/084587

PCT Pub. Date: Jun. 2, 2016

(65) Prior Publication Data

US 2017/0346230 A1 Nov. 30, 2017

(30) Foreign Application Priority Data

Nov. 28, 2014 (JP) ..... 2014-240874

(51) Int. Cl.
*H01R 13/514* (2006.01)
*H01R 13/639* (2006.01)
(Continued)

(52) U.S. Cl.
CPC ..... *H01R 13/639* (2013.01); *H01R 13/514* (2013.01); *H01R 13/518* (2013.01);
(Continued)

(58) Field of Classification Search
CPC ..... H01R 13/5202; H01R 13/518; H01R 13/514; H01R 13/639; H01R 31/08; H01R 33/7671
(Continued)

(56) References Cited

U.S. PATENT DOCUMENTS 5,288,251 A * 2/1994 Sumida ..... H01R 13/514 439/701
5,549,490 A * 8/1996 Buetas ..... H01R 13/514 439/721
(Continued)

FOREIGN PATENT DOCUMENTS

| | | |
|---|---|---|
| JP | 5-74514 | 3/1993 |
| JP | 9-17497 | 1/1997 |
| JP | 3813711 | 6/2006 |

OTHER PUBLICATIONS

International Search Report dated Dec. 28, 2015.

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

It is aimed to enable a plurality of housings to be stacked without enlarging a connector. A connector includes a housing (60) including a lock receiving portion (67) inside and a case (10) internally provided with accommodation areas (13) capable of accommodating a plurality of the housings (60) in parallel and including lock portions (21) on back surfaces (18) of the accommodation areas (13), and the lock portions (21) resiliently lock the lock receiving portions (67) of the respective housings (60) to restrict the separation of the housings (60) from the accommodation areas (13).

2 Claims, 6 Drawing Sheets

(51) Int. Cl.
*H01R 33/76* (2006.01)
*H01R 13/518* (2006.01)
*H01R 13/52* (2006.01)
*H01R 31/08* (2006.01)

(52) U.S. Cl.
CPC ..... *H01R 13/5202* (2013.01); *H01R 31/08* (2013.01); *H01R 33/7671* (2013.01)

(58) Field of Classification Search
USPC ..... 439/953, 717, 262, 594, 712, 724, 701
See application file for complete search history.

(56) References Cited

U.S. PATENT DOCUMENTS 5,554,051 A * 9/1996 Shinji ..... H01R 13/4368 439/595
5,612,854 A * 3/1997 Wiscombe ..... G06F 1/184 361/679.6
5,634,824 A * 6/1997 Yagi ..... H01R 13/514 439/701
5,788,347 A * 8/1998 Rabinovitz ..... A47B 87/0215 312/111
5,868,583 A * 2/1999 Naitou ..... H01R 13/6271 439/701
5,992,953 A * 11/1999 Rabinovitz ..... A47B 87/02 312/111
6,231,398 B1 * 5/2001 Furutani ..... H01R 13/506 439/701
6,851,985 B2 * 2/2005 Lafragette ..... H02B 1/26 439/701
7,445,471 B1 * 11/2008 Scherer ..... H01R 13/506 439/108
8,210,881 B2 * 7/2012 Sasaki ..... H01R 13/506 439/701
8,936,474 B2 * 1/2015 Katsuse ..... H01R 9/223 439/701

* cited by examiner

CONNECTOR

BACKGROUND

1. Field of the Invention

The invention relates to a connector.

2. Description of the Related Art

Japanese Unexamined Patent Publication No. H09-17497 discloses a connector with male and female housings that are connectable to each other. The male housing includes two fitting recesses (accommodation areas) and two hooks project on both end parts with the fitting recesses located therebetween. Each female housing is in the form of a block and a resilient locking piece projects on an outer surface of the female housing. The female housings are fit into the respective fitting recesses are retained therein by resiliently locking the resilient locking piece to the hook with the female housing accommodated in the respective fitting recess.

The hooks of the above-described connector project on both end parts of the male housing with the fitting recesses located therebetween. Thus, there is a problem that the male housing and, consequently, the entire connector, are enlarged in an arrangement direction of the fitting recesses. Further, the resilient locking piece projects on the outer surface of the female housing. Thus, even if it is attempted to collectively connect a plurality of the female housings to the male housing while holding the female housings in a stacked state, there is a problem that the resilient locking pieces stand in the way and the stacked state of the female housings cannot be maintained.

The invention was completed based on the above situation and aims to enable a plurality of housing to be stacked without enlarging a connector.

SUMMARY

The invention is directed to a connector with housings, each of which has a lock receiving portion inside. The connector also includes a case internally provided with an accommodation area capable of accommodating a plurality of the housings in parallel. Lock s are provided on a back surface of the accommodation area, the locks resiliently lock the lock receiving portions of the respective housings to restrict the separation of the housings from the accommodation area.

The lock receiving portion is inside the housing and the lock is provided on the back surface of the accommodation area in the case. Thus, there is no possibility that the lock receiving portion projects out of the housing and the lock portion projects out of the case. Accordingly, enlargement of the connector in an arrangement direction of the housings can be prevented. Further, the lock receiving portion does not project out of the housing so that the plurality of housings can be stacked in the arrangement direction.

The housing may include a jig insertion hole extending from a position facing the lock receiving portion in a direction opposite to an insertion direction into the housing and open on an end surface. A jig may be insertable into the jig insertion hole through an opening in the end surface for unlocking the lock and the lock receiving portion from each other. The lock receiving portion is provided inside the housing and the lock is provided on the back surface of the accommodation area of the case. Thus, it is difficult to unlock the lock and the lock receiving portion from each other. However, the portion and the lock receiving portion easily can be unlocked from each other by inserting the jig into the jig insertion hole.

A surface facing the adjacent housing with the housing accommodated in the accommodation area has no locking structure and is capable of facing and coming into contact with the adjacent housing. Accordingly, the respective housings can be held in a state stacked in the arrangement direction by a fitting jig or the like and can collectively fit into the accommodation area of the case via the fitting jig or the like.

DETAILED DESCRIPTION

An embodiment is described on the basis of the drawings. A connector of the present invention includes a case 10 and a plurality of housings 60 that can be accommodated and held in the case 10. The case 10 is configured as a mating housing having busbars 90 (see FIG. 2) mounted therein, and the connector is configured as a so-called joint connector. Note that, in the following description, surfaces of the housings 60 and the case 10 facing each other when the housings 60 are accommodated into the case 10 are referred to front sides concerning a front-rear direction and a vertical direction is based on FIGS. 2 and 5.

Figure 1:
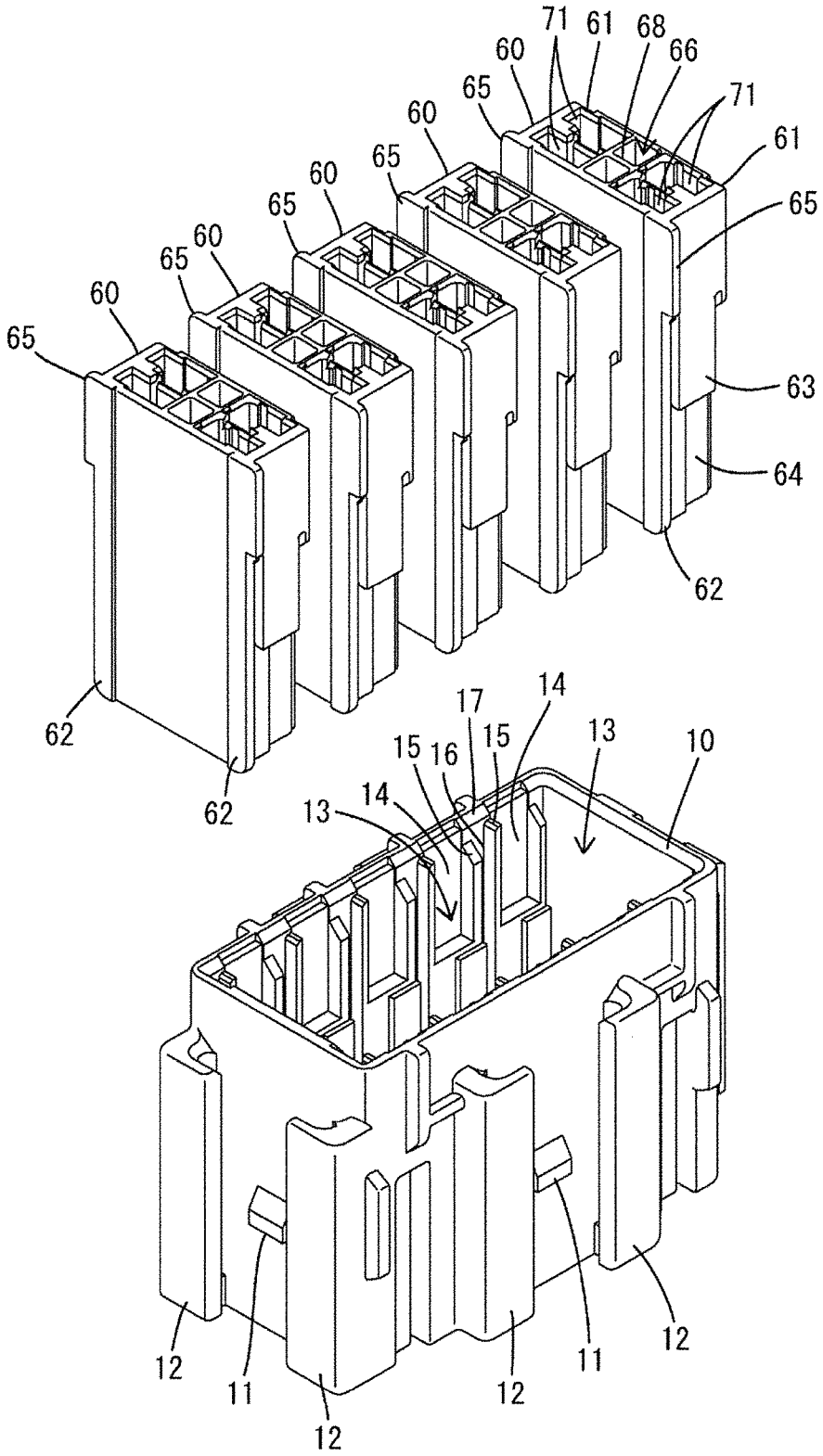
FIG. 1 is an exploded perspective view of a connector according to an embodiment of the present invention.
Figure 2:
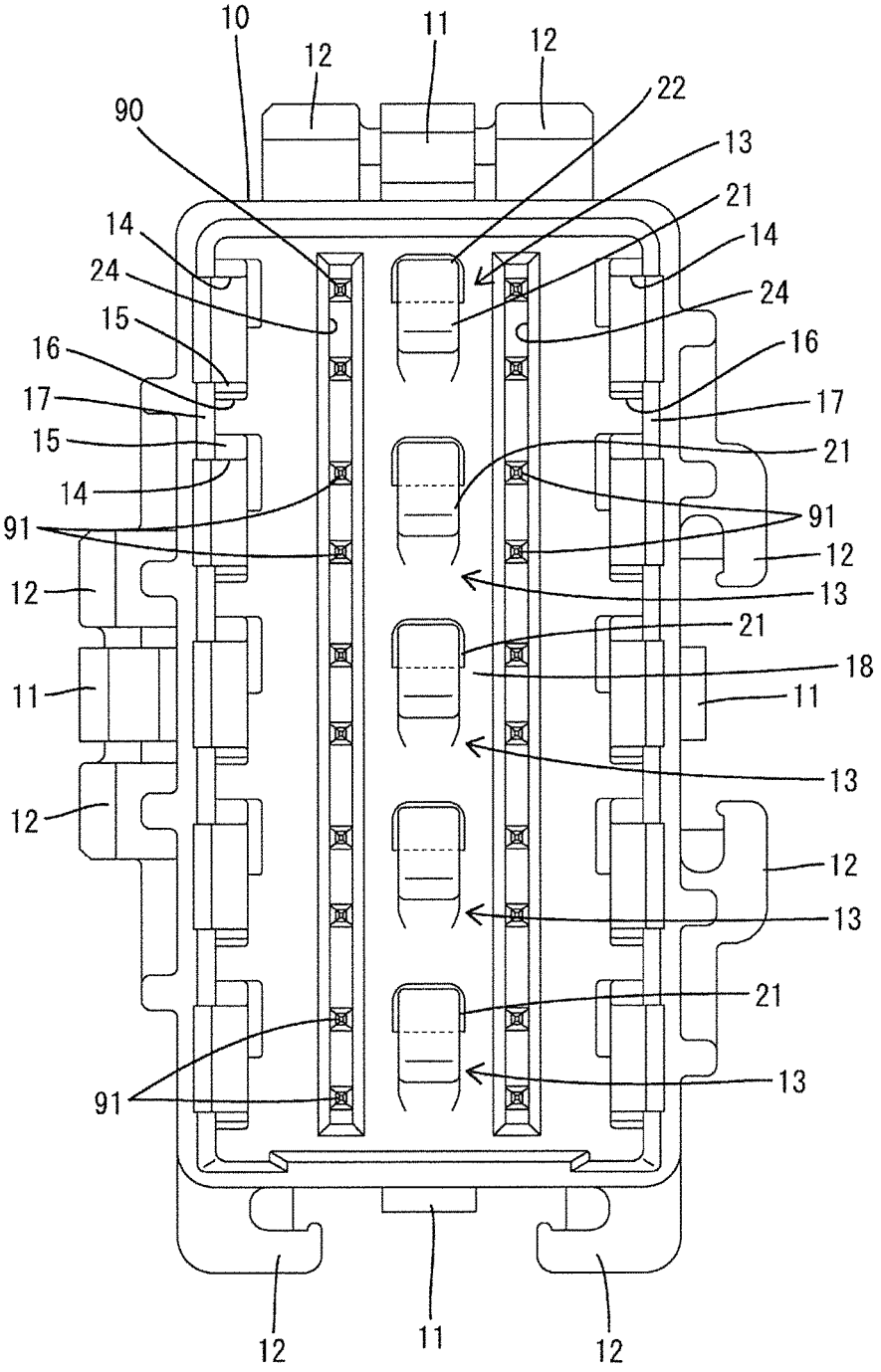
FIG. 2 is a front view of a case.
Figure 3:
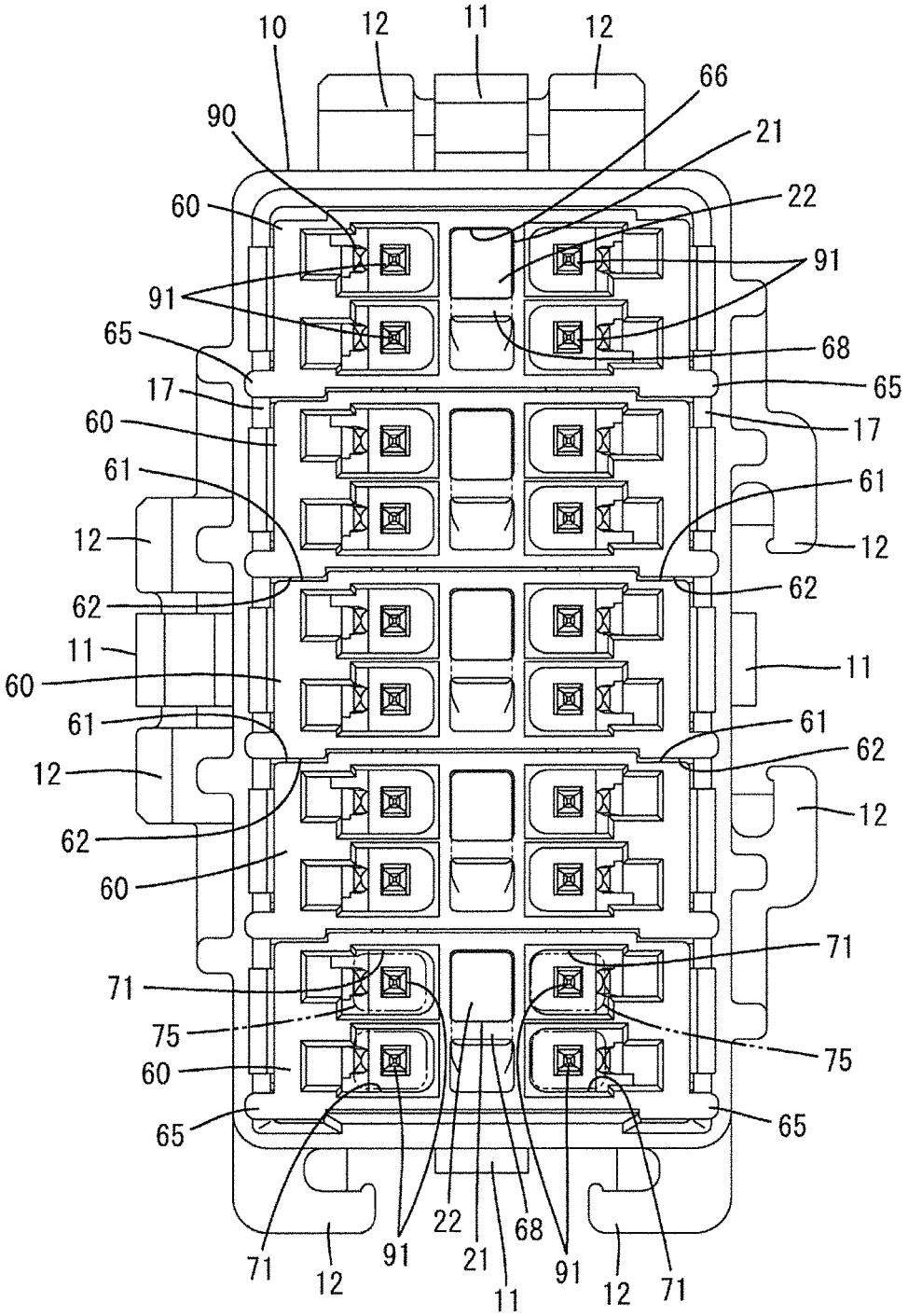
FIG. 3 is a front view of the case with housings accommodated in accommodation areas.

The case 10 is made of synthetic resin and is in the form of a rectangular box that is long in the vertical direction and open forward (see FIG. 1). As shown in FIGS. 2 and 3, mounting locks 11 project on four outer side surfaces of the case 10 and two guide walls 12 extend in the front-rear direction at opposite sides of each mounting lock 11. The case 10 is slid and mounted onto an unillustrated mounting member, such as a bracket, while being guided by the guide walls 12, and fixed to the mounting member via the mounting locks 11.

As shown in FIG. 2, busbars 90 project in the case 10. Further, accommodation areas 13 are provided in the case 10 and are arranged in parallel in the vertical direction at positions corresponding to projecting portions 91 of the busbars 90. The housing 60 can be accommodated into each accommodation area 13 from the front.

As shown in FIGS. 1 and 2, fitting recesses 14 are provided on opposite side surfaces in the case 10 at positions corresponding to the respective accommodation areas 13. The fitting recesses 14 extend in the front-rear direction and are open on the rear end of the case 10 Further, guide grooves 16 are provided between walls 15 defining the fitting recesses 14 between adjacent accommodation areas 13. The guide grooves 16 extending in the front-rear direction and open on the rear end of the case 10 Pairs of stopper surfaces 17 are provided to be widened forward at opposite sides of the respective accommodation areas 13 on opposite side walls of the case 10. Note that no partition wall is provided in the case 10 to portion between adjacent accommodation areas 13.

Figure 4:
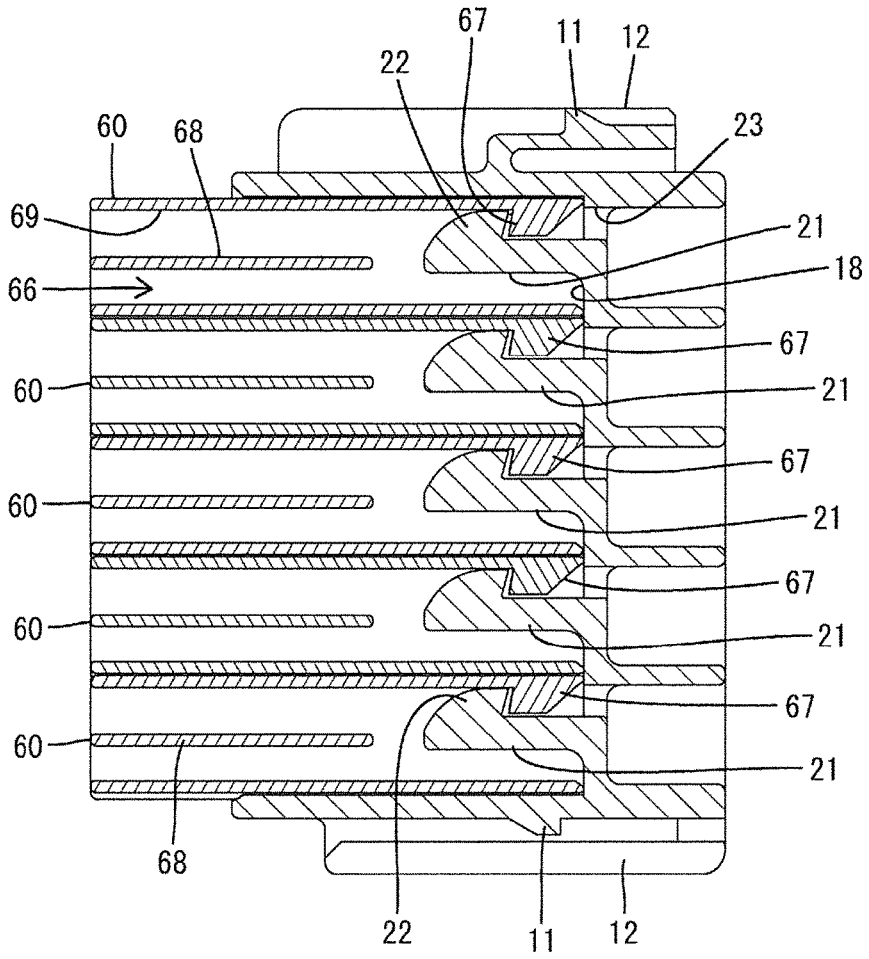
FIG. 4 is a section of the case of FIG. 3.

As shown in FIGS. 2 and 4, a lock 21 is provided on a back surface 18 of each accommodation area 13 in the case 10 and is capable of retaining and holding the housing 60. The lock 21 is cantilevered forward from a widthwise central part of the back surface 18 of the accommodation area 13 and is deflectable and deformable in the vertical direction with the back surface 18 of the accommodation area 13 serving as a support. A claw-like lock projection 22 projects up on a tip part of the lock 21. As shown in FIG. 4, the front surface of the lock projection 22 has an arcuate shape in a side sectional view and the rear surface thereof has a reverse tapered shape toward a projecting upper end. A mold removal hole 23 is provided in the rear surface of the case 10 at a position facing the lock projections 22 and is formed by the passage of a mold in molding the rear surfaces of the lock projections 22 is provided.

As shown in FIG. 2, the lock 21 is disposed substantially in a central part of each accommodation area 13 in a front view. Pairs of the projecting portions 91 of the busbars 90 are arranged at opposite sides of the lock 21 in each accommodation area 13. Two vertical mounting grooves 24 are open at opposite sides of the respective locks 21 in the back surfaces 18 in the case 10, and the busbars 90 are press-fit and mounted into the mounting grooves 24.

The housing 60 is made of synthetic resin and is in the form of a flat block thin in the vertical direction (see FIG. 1). As shown in FIGS. 1 and 3, two fitting grooves 61 extend in the front-rear direction on both widthwise end parts of the upper surface of the housing 60, and two fitting ribs 62 extend in the front-rear direction on both widthwise end parts of the lower surface of the housing 60. Further, the fitting ribs 62 protrude toward opposite lateral sides of the housing 60.

As shown in FIG. 1, fitting portions 63 are provided on opposite side surfaces of the housing 60 and project slightly farther out than front parts 64. The fitting portions 63 are fittable into the fitting recesses 14 when the housing 60 is accommodated in the accommodation area 13. The housing 60 is guided into the accommodation area 13 by fitting laterally protruding parts of the fitting recesses 62 into the guide grooves 16.

Further, as shown in FIG. 1, stoppers 65 protrude laterally from rear end parts of opposite side surfaces of the housing 60 and extend in the front-rear direction along the lower edge of the housing 60 between the rear end of the housing 60 and the fitting ribs 62. The front ends of the stoppers 65 are stopped in contact with the stopper surfaces 17 to restrict any deeper insertion of the housing 60 into the accommodation area 13 (see FIG. 3). With the housing 60 properly accommodated in the accommodation area 13, a rear end part of the housing 60 including the stoppers 65 is arranged to be exposed behind the housing 60.

As shown in FIGS. 1 and 3, a lock hole 66 is provided in a widthwise central part of the housing 60 for receiving the lock 21. The lock hole 66 is a substantially rectangular opening and penetrates through the housing 60 in the front-rear direction, as shown in FIG. 4. A claw-like lock receiving portion 67 projects down on the upper surface of a front end part of the hole surface of the lock hole 66 of the housing 60. The front end of the lock receiving portion 67 is tapered to incline rearward toward a projecting end (lower end) and the rear surface thereof has a reverse tapered shape slightly inclined rearwardly toward the projecting end. The lock projection 22 of the lock 21 is lockable to the lock receiving portion 67. Here, a projecting amount of the lock receiving portion 67 is substantially equal to that of the lock projection 22.

Figure 5:
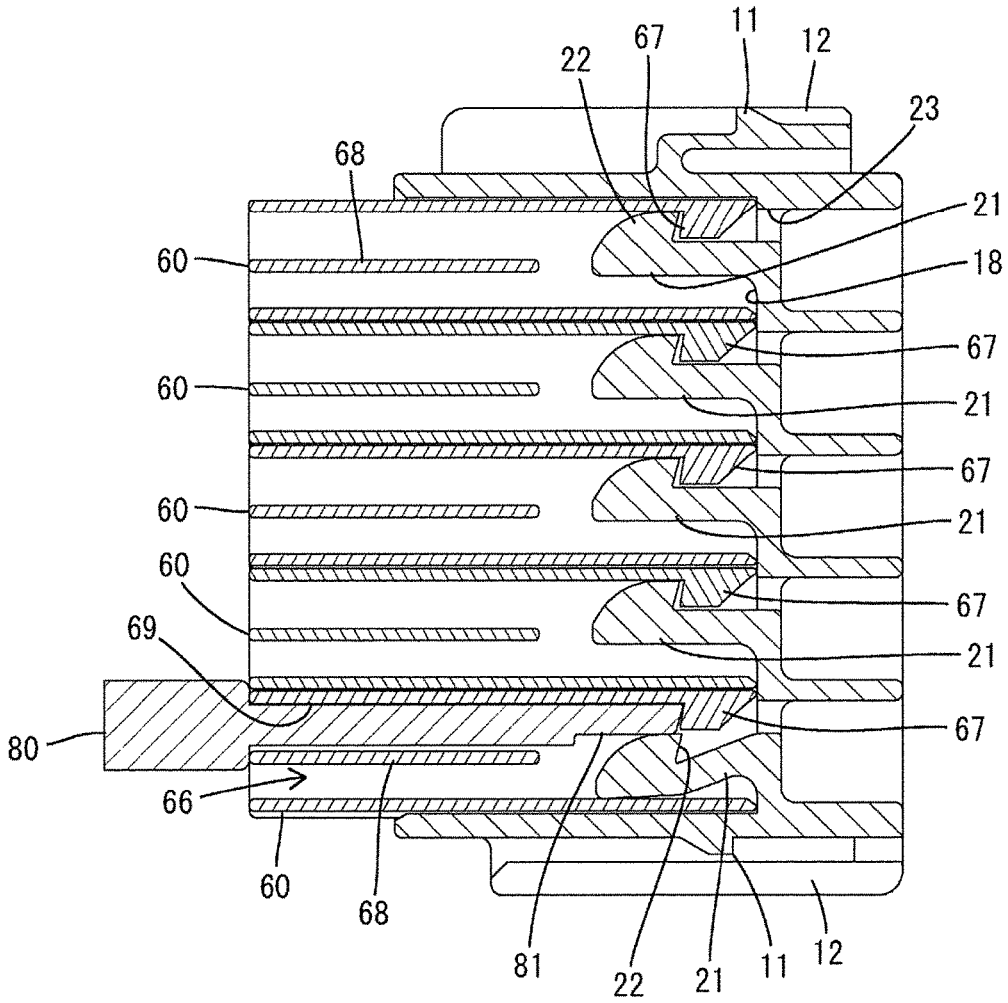
FIG. 5 is a section showing a state where a lock portion and a lock receiving portion are unlocked from each other by a jig for unlocking.

Further, as shown in FIG. 4, a separation wall 68 is provided in the lock hole 66 of the housing 60 and vertically divides a substantially rear half of the lock hole 66. Specifically, the separation wall 68 is arranged slightly below a vertical center of the lock hole 66. A jig insertion hole 69 is provided in an area of the lock hole 66 above the separation wall 68 and extends in the front-rear direction from the rear surface of the lock receiving portion 67 to a rear end opening of the housing 60. As shown in FIG. 5, a jig 80 for unlocking is inserted into the jig insertion hole 69 through the rear end opening of the housing 60 while being guided, and the lock 21 and the lock receiving portion 67 can be unlocked from each other by the inserted jig 80.

Further, as shown in FIG. 3, the housing 60 is provided with pairs of cavities 71 at opposite sides of the lock hole 66. A terminal fitting 75 not shown in detail is inserted and accommodated into each cavity 71 from behind. The terminal fitting 75 is connected to an end part of an unillustrated wire and conductively connected to the busbar 90 with the housing 60 accommodated in the accommodation area 13.

Next, functions of this embodiment are described.

The housings 60 are stacked in the vertical direction for accommodation into the case 10. Specifically, the respective housings 60 are stacked such that the lower surface of the upper housing 60 faces substantially in close contact with the upper surface of the lower housing 60. At this time, the fitting ribs 62 of the upper housing 60 are fit into the fitting grooves of the lower housing 60, thereby restricting the vertically adjacent housings 60 from being displaced from each other in the width direction (see FIG. 3).

Figure 6:
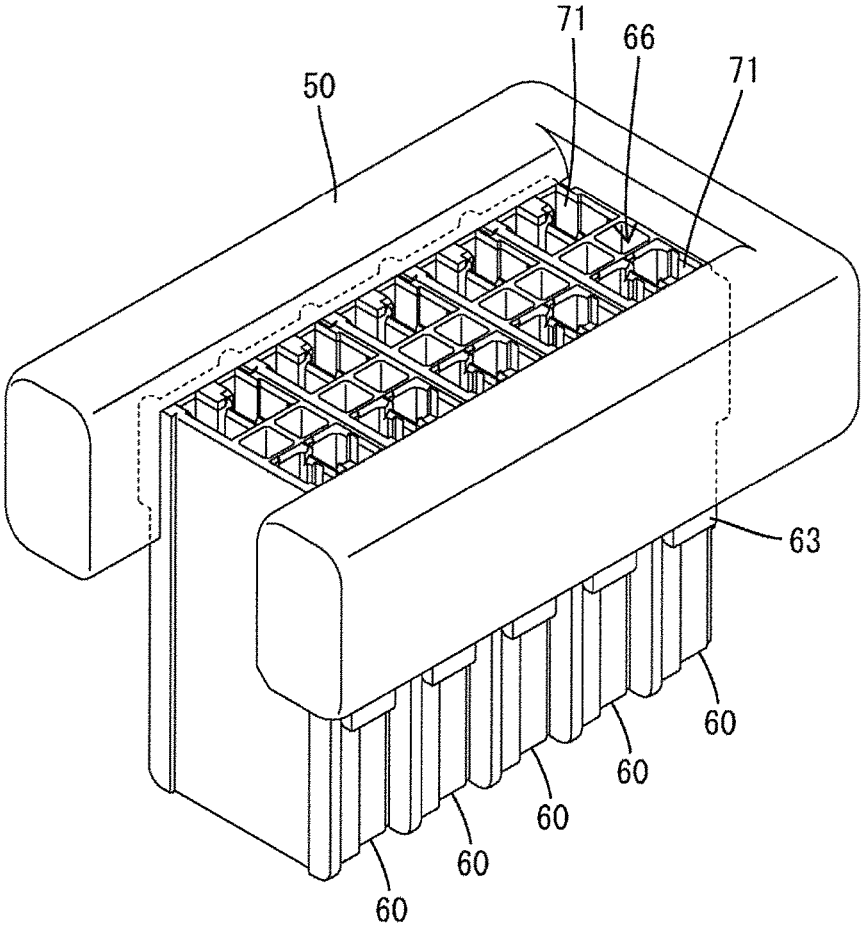
FIG. 6 is a perspective view showing a state where the respective housings are mounted in a fitting jig.

The aforementioned stacked state of the housings 60 is stably held by using a fitting jig 50 shown in FIG. 6. As shown in FIG. 6, the fitting jig 50 is in the form of a U-shaped frame, and the rear end parts (parts exposed to outside with the housings 60 accommodated in the accommodation areas 13) of the respective housings 60 can be held in the stacked state inside the frame.

With the respective housings 60 opposed to the corresponding accommodation areas 13, the fitting jig 50 is brought closer to the case 10. Then, the respective housings 60 are inserted collectively into the corresponding accommodation areas 13. In the process of inserting the housings 60 into the accommodation areas 13, the lock projections 22 interfere with the lock receiving portions 67 to deflect and deform the locks 21. Further, in the inserting process, the fitting ribs 62 of the housings 60 are inserted into the guide grooves 16 to guide an inserting operation of the housings 60. When the housings 60 are inserted properly inserted into the accommodation areas 13, the fitting portions 63 are fit into the fitting recesses 14 and the stoppers 65 contact the stopper surfaces 17 to restrict any further insertion. Further, when the housings 60 are inserted properly into the accommodation areas 13, as shown in FIG. 4, the locks 21 resiliently return and the lock projections 22 and the lock receiving portions 67 are arranged to be lockable to each other. In this way, the housings 60 are retained and held in the case 10.

The housing 60 may have to be from the case 10 for maintenance or the like. Thus, the jig 80 for unlocking is inserted into the jig insertion hole 69 through the rear end opening of the housing 60, as shown in FIG. 5. The jig 80 includes a pin-like jig body 81 long and narrow in the front-rear direction, and the jig body 81 is inserted straight into the jig insertion hole 69 while being guided. When the jig body 81 is inserted to a proper depth into the jig insertion hole 69, the tip of the jig body 81 interferes with the lock projection 22 to deflect and deform the lock 21 down. Then, the lock projection 22 is separated from the lock receiving portion 67 to unlock the lock 21 and the lock receiving portion 67 from each other. The housing 60 then can be pulled out and separated from the case 10.

As described above, the lock receiving portion 67 is provided inside the housing 60 and the lock 21 is provided on the back surface 18 of the accommodation area 13 in the case 10. Thus, there is no possibility that the lock receiving portion 67 projects out of the housing 60 and the lock 21 projects out of the case 10, and the enlargement of the connector in the vertical direction (arrangement direction of the housings 60) can be prevented. Further, since the lock receiving portion 67 does not project out of the housing 60, a plurality of the housings 60 can be stacked in the vertical direction without any problem. Particularly, the respective housings 60 in the stacked state can be fit collectively into the case 10 via the fitting jig 50. Thus, operability can be further improved. Further, by inserting the jig 80 for unlocking into the jig insertion hole 69 through the rear end opening of the housing 60, the lock 21 and the lock receiving portion 67 can be easily unlocked from each other.

Other embodiments are briefly described below.

The adjacent housings may not be in contact with each other with the respective housings accommodated in the accommodation areas of the case.

In the case of described above, the case may be provided with partition walls for partitioning between the adjacent housings.

The case may be for accommodating the housings without having the busbars mounted therein.

LIST OF REFERENCE SIGNS

10 . . . case
11 . . . mounting lock
13 . . . accommodation area
18 . . . back surface (of accommodation area)
21 . . . lock
60 . . . housing
67 . . . lock receiving portion
69 . . . jig insertion hole
80 . . . jig (for unlocking)

The invention claimed is:

1. A connector, comprising:

a housing including a lock receiving portion inside; and a case internally provided with an accommodation area capable of accommodating a plurality of the housings in parallel and including locks on a back surface of the accommodation area, the locks resiliently locking the lock receiving portions of the respective housings to restrict the separation of the housings from the accommodation area, wherein the housing includes a jig insertion hole extending from a position facing the lock receiving portion in a direction opposite to an insertion direction into the housing and open on an end surface, a jig for unlocking the locks and the lock receiving portion from each other being insertable into the jig insertion hole through an opening in the end surface.

2. The connector of claim 1, wherein, out of outer surfaces of the housing, a surface facing the adjacent housing with the housing accommodated in the accommodation area has no locking structure and is capable of facing and coming into contact with the adjacent housing.

* * * * *